US005977925A

United States Patent [19]

Hamnén et al.

[11] Patent Number: 5,977,925

[45] Date of Patent: Nov. 2, 1999

[54] DEVICE FOR ANTENNA SYSTEMS

[75] Inventors: Jan Håkan Hamnén, KÅllered; Tomas Mikael Petrus Stanek, Mölndal, both of Sweden

[73] Assignee: Telefonaktiebolaget LM Ericsson, Stockholm, Sweden

[21] Appl. No.: 09/113,313

[22] Filed: Jul. 10, 1998

[30] Foreign Application Priority Data

Jul. 11, 1997 [SE] Sweden ..... 9702686

[51] Int. Cl.[6] ..... H01Q 13/10

[52] U.S. Cl. ..... 343/771

[58] Field of Search ..... 343/771, 700

[56] References Cited

U.S. PATENT DOCUMENTS

| | | | |
|---|---|---|---|
| 4,684,952 | 8/1987 | Munson | 343/700 |
| 5,172,127 | 12/1992 | Josefsson | 343/771 |
| 5,461,392 | 10/1995 | Mott et al. | 343/725 |

FOREIGN PATENT DOCUMENTS

95/15592 6/1995 WIPO .

*Primary Examiner*—Thomas H. Tarcza
*Assistant Examiner*—Devin Drummond
*Attorney, Agent, or Firm*—Burns, Doane, Swecker & Mathis, L.L.P.

[57] ABSTRACT

The present invention relates to a device at an antenna for eliminating grid lobes in the radar cross section of the antenna.

The invention displaces the grid lobes to a frequency range outside the working frequency of the antenna by inserting rows of dummy elements ($r_3$, $r_4$, $r_5$) between rows of ordinary antenna elements ($r_1$, $r_2$) in the antenna (11). The dummy elements will behave like the ordinary antenna elements (15) as regards the rescattering when the dummy elements (17) are irradiated with signals from outside. Furthermore, the dummy elements (17) are not fed by a feeding network (**16*a*, 16*b*) with microwave signals as is the case with the ordinary antenna elements (15). The dummy elements (17**) are arranged in the rows of dummy elements ($r_3$, $r_4$, $r_5$) so that the distances in X-direction and in Y-direction ($a_4$, $a_5$, $a_6$, $a_7$, $a_8$) between these elements and nearby ordinary elements are less than half a wavelength of the threat frequency of the antenna. The threat frequency constitute the frequency range in which an incoming signal to the antenna constitutes a threat. Thereby no grid lobes will occur in the radar cross section of the antenna.

8 Claims, 2 Drawing Sheets

DEVICE FOR ANTENNA SYSTEMS

FIELD OF THE INVENTION

The present invention relates to a device for elimination of grid lobes in a radar cross section of an antenna for military use or other possible use.

BACKGROUND OF THE INVENTION

According to prior art a radar cross section (RCS=radar cross section) of an object is referred to as the effective rescattering of the object, when it is iradiated from the outside. The radar cross section is in other words a measurement of how well the object is visible with a radar. To decrease the risk of an other radar to localize an object, for instance an antenna, it is required that its radar cross section is minimized.

Antennas are constructed to be used within particular specific frequency ranges, for instance about the 10 GHz frequency range. In this text, the working frequency of the antenna is defined as the frequency range for which the antenna is designed to be used.

In this text the threat frequency of the antenna is defined for which an incoming signal to the antenna constitutes a threat, when the incoming signal has a frequency which is in this frequency range. Below, the incoming signal is defined as the signal is within the threat frequency, because all other incoming signals to the antenna are not of interest, since they do not constitute a threat to the antenna.

Antennas according to prior art can comprise a normally flat disc, acting as ground plane and provided with antenna elements, which for instance can consist of through openings in the disc. Microwaves irradiate through the openings, when the openings are fed by a feeding network with microwave signals. The feeding network can consist of a wave guide. This is well known to the person skilled in the art.

Other types of elements can for instance be dipoles, wave guide openings, so-called horn and micro strip elements, so-called patches.

Other types of feeding networks can for instance comprise coaxial conductors, micro strip and strip line.

According to prior art most of the antennas of design reasons are provided with substantially uniform antenna element patterns, i. e., the antenna elements are arranged in a periodical pattern in the antenna, and the distances between the antenna elements are between one half and one whole wave length of the working frequency of the antenna.

When the openings in above disclosed disc are arranged in a periodical pattern in the disc, the micro wave signals, which normally are transmitted from the antenna elements, can cause strong constructive interference, i. e., co-operation of the microwave signals, in more directions than the intended head lobe direction. These strong interferences are termed grid lobes in the radiation diagram of the antenna.

At reception of signals in the antenna, the grid lobes correspondingly give a high sensitivity for signals incoming to the antenna from more directions than the direction of the head lobe.

Likewise, if the antenna from outside is irradiated with a signal having a frequency lying close to or above the working frequency of the antenna, grid lobes will arise also in particular directions in the radar radar cross section of the antenna, in which the beams reflected to the antenna in the signal co-operate with each other. These directions corresponds to a high value of reflection, i. e., the radar cross section (RCS) becomes large.

The arrangement of the grid lobes in space is determined by the distance between the antenna elements and which frequency the antenna works or is irradiated from outside. In the case where an antenna is employed for transmitting or receiving signals in a fixed direction, substantially perpendicular to the front area of the antenna, the minimum distance between the antenna elements can be slightly more than one wave length without grid lobes occurring in the radiation diagram of the antenna.

However, in the case an antenna is irradiated from outside of an to the antenna incoming signal, the distance between the antenna elements must be less than half a wave length of the incoming signal for grid lobes not occurring in the radar cross section of the antenna.

Depending on which threat frequency the antenna has, there will be different requirements on distances between the antenna elements (less than half a wave length of the threat frequency) for grid lobes not occurring in the radar cross section of the antenna, wherein it most often is the threat frequency of the antenna, which controls the packing density of the antenna elements in the antenna.

The existence of grid lobes in particular directions in the radar cross section of the antenna can easily be avoided totally if the antenna elements do not form a regular pattern in the antenna. In this case there will be no direction from the antenna elements within the radar cross section of the antenna in which the transmitted beams or the to the antenna reflected beams co-operate with each other, so a strong constructive interference occurs within the radar cross section of the antenna. However, because of design technical reasons, most of the antennas are provided with substantially regular antenna element patterns.

The packing density between the antenna elements of an antenna can according to prior art not be designed infinitely high of physical reasons. This is depending on that the working frequency of the antenna determines the dimension of the wave guides feeding the antenna elements. Thereby the wave guides cannot be made as small as possible, which delimits the distance between the antenna elements to a particular minimum distance. The result is that grid lobes occur in the radar cross section of the antenna if the antenna elements are arranged in a periodical pattern in the antenna, because the antenna elements cannot be packed infinitely dense.

A method according to prior art to decrease the distance between the antenna elements of an antenna is to use a material with a high dielectric constant, said material being arranged in the antenna elements and their feeding net work. The physical dimension of the antenna element and the feeding net work hereby becomes less and the packing density between the antenna elements becomes larger, whereby created grid lobes are moved up in the frequency band.

A drawback with the method described above is that the complexity is high in manufacturing of the antenna and the antenna is expensive to manufacture.

An other drawback is that the dielectric material normally implies increased losses.

In U.S. Pat. No. 5,461,392 an antenna system is disclosed comprising trays, in which a space between the trays is employed, in which space an attenuating material is arranged for reducing reflections of microwaves coming from the antenna system in the frequency range, where the attenuating material has an attenuating effect.

A disadvantage with this method is that grid lobes, as described above, occur in particular directions from the antenna system.

In U.S. Pat. No. 4,684,952 an antenna device is disclosed comprising a group of elements where feeding conductors to the elements are not connected to any transmitter or receiver, but the elements are only used for reflecting or absorbing signals. The elements can be connected to terminators, be short cut, or open conductors with phase shifters. In the latter cases, the signals the element receives can be retransmitted in desired direction. For instance, they can be retransmitted to the source of the incoming signal, in harmless direction, or be transmitted to a in front of the element group arranged feeder and thereby form a reflector antenna for transmission and reception of signals.

DISCLOSURE OF THE INVENTION

The object of the present invention is to eliminate the presence of grid lobes in a radar cross section of an antenna device by an inexpensive method, as the in the antenna device comprised ordinary antenna elements are arranged in a periodical pattern.

This is achieved according to the present invention by employing a displacement of the grid lobes to a frequency outside the threat frequency of the antenna device, disclosed above, by placing in dummy elements between the ordinary antenna elements in the antenna device.

The dummy elements displace the direction of the above described co-operating reflected beams, from an incoming signal to the antenna device, out of the threat frequency of the antenna device.

In more detail, the method is that in an antenna device, comprising ordinary antenna elements, which due to their periodical pattern form regular rows in several different directions, rows of dummy elements are arranged between rows of ordinary elements having a larger mutual distance than half a wave length of the threat frequency of the antenna device, disclosed above, between nearby ordinary antenna elements. The dummy elements are arranged in the row of dummy elements so the distance between these and said nearby ordinary antenna elements is less than half a wave length of the threat frequency of the antenna device.

The ordinary elements are fed by a feeding net work with microwave signals, and the dummy elements are blind and differ from the ordinary antenna elements in such a way that the dummy elements are not fed by a feeding net work. On the other hand, the dummy elements rescatter in the same way as the ordinary elements, when the dummy elements are irradiated from outside with signals.

The device of the invention can alternatively be designed as an afterwards attached additional ground plane to the antenna device, wherein the ground plane comprises said dummy elements as disclosed above and through original antenna elements, conforming to the ordinary antenna elements of the antenna device.

One advantage of the present invention is that the packing density of the antenna elements in the antenna devices can be made sufficiently high to eliminate the presence of grid lobes in the radar cross section of the antenna device.

Another advantage is that the device of the invention is cheap to produce in an existing antenna device.

The present invention will now be described in more detail with reference to preferred embodiments of the invention and illustrated in the accompanying drawings.

DETAILED DESCRIPTION OF THE PREFERRED EMBODIMENTS

Figure 1:
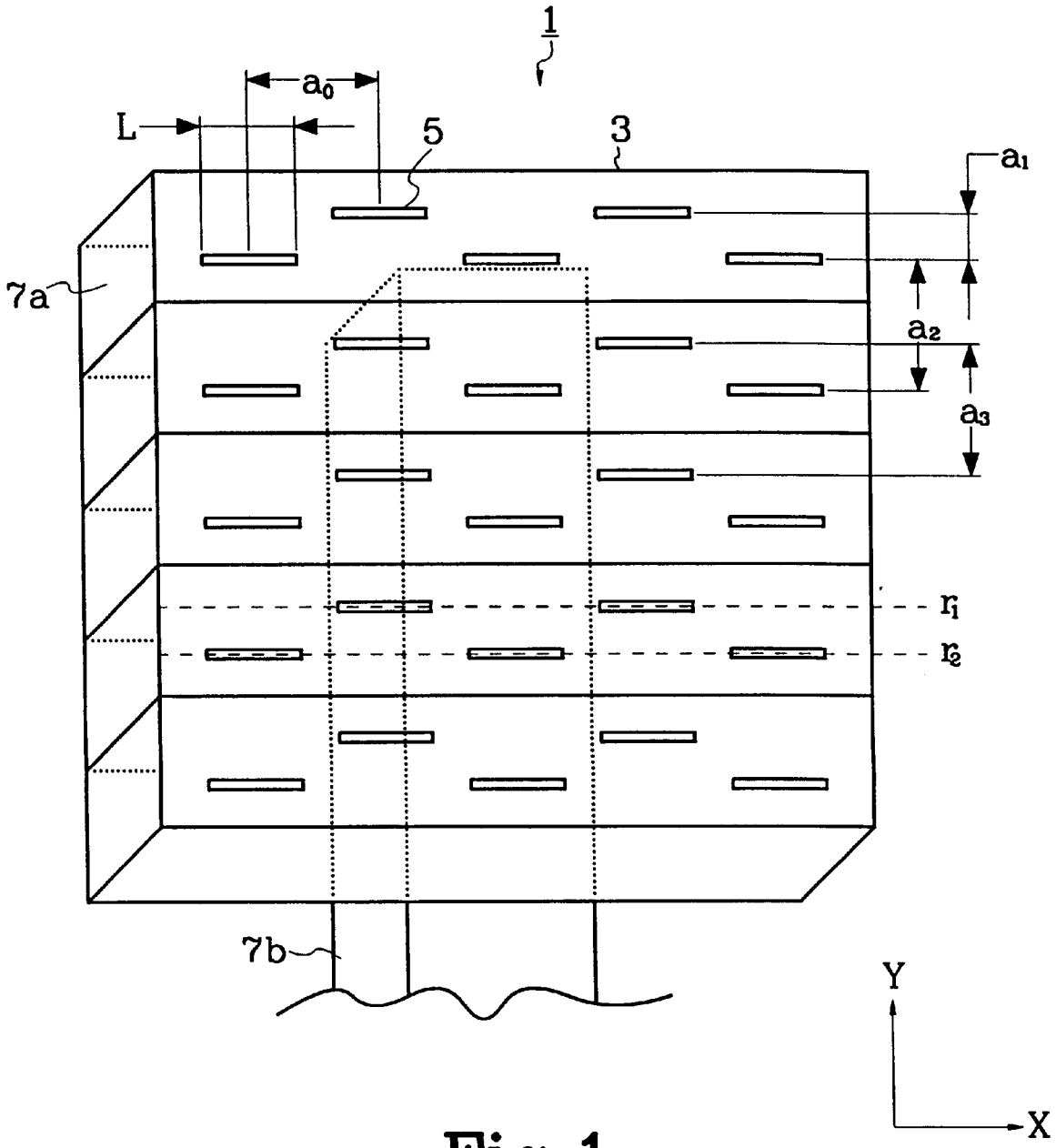
FIG. 1 illustrates a schematic front view of an antenna device according to prior art.

FIG. 1 illustrates an antenna device 1 according to prior art comprising five identical sections stacked onto each other, comprising a disc 3 with antenna elements. The antenna elements in this particular case constitute openings 5. The openings 5 are through openings and arranged in a periodical pattern in the disc 3, as is illustrated in FIG. 1. The openings 5 in each section are fed with micro wave signals by microwave units from a wave guide 7*a*, being fed by a feeding wave guide 7*b* via a slit (not illustrated in FIG. 1).

So-called grid lobes, further disclosed in more detail as above, occur in the radar cross section below, of the antenna device 1. The radar cross section is disclosed in more detail above and is a well-known phenomena for a person skilled in the art.

Grid lobes occur in the radar cross section of the antenna device because the distance between the openings 5 in the disc 3 cannot be made less than half a wave length of the so-called threat frequency of the antenna device, which has been described in more detail above. This depends on that the dimensions of the wave guides 7*a* cannot be made sufficiently small as disclosed above, whereby the distance between the openings 5 is limited to a particular minimum distance being larger than half a wave length of the threat frequency of the antenna device.

Each section in the antenna device 1 comprises two rows with openings 5. A first row $r_1$ comprises two openings and a second row $r_2$ comprises three openings 5.

In the fixed co-ordinate system of the antenna device X-Y according to FIG. 1, the X-axis and Y-axis are in the plane of the paper, whereby the X-axis is parallel to the first row $r_1$ and the second row $r_2$ in each section in the antenna device 1, and the Y-axis is perpendicular to the X-axis.

In FIG. 1, the distance in X-direction between the mid-points of the openings is designated $a_0$. The distance in Y-direction between the mid-point of the openings in the first row $r_1$ and the mid-point of the openings in the second row $r_2$ of each section is designated $a_1$, the distance in Y-direction between the mid-points of the openings in the first rows $r_1$ of nearby sections is designated $a_2$ and the distance in Y-direction between the mid-points-points of the openings in the second rows $r_2$ of nearby sections is designated $a_3$.

One example of the dimensions of the antenna device 1 in FIG. 1 according to prior art follows below. In the figure, the length of the openings 5, designated L in the figure, equals to half a wave length of the working frequency of the antenna device. Above described distances $a_0$, $a_2$ and $a_3$ equal 0,7 wave lengths of the working frequency of the antenna device and the distance $a_1$ is less than half a wave length of the working frequency of the antenna device.

Simple mathematical calculations give that the distances $a_0$, $a_2$ and $a_3$ between the openings 5 in the example above are larger than half a wave length of the threat frequency of the antenna device, when the threat frequency is close to or above the working frequency of the antenna, whereby grid lobes can occur in the radar cross section of the antenna device in both X-direction and Y-direction to an incoming signal to the antenna device 1.

For instance it is assumed that the threat frequency is larger than 0,8 multiplied by the working frequency, rendering the wave length of the working frequency larger than 0,8 multiplied by the wave length of the threat frequency since the working frequency and the threat frequency in a known manner are inversely proportional to each respective wavelength. The distances $a_0$, $a_2$ and $a_3$ are equal to 0,7 wave lengths of the working frequency, said distances $a_0$, $a_2$ and $a_3$ according to said calculations then become larger than 0,56 wave lengths of the threat frequency.

An embodiment of the present invention will now be described with reference to the example as above, whereby the distances between elements in an antenna device are less than half a wave length of the threat frequency of the antenna device. In this example, the expression element is defined as a collection expression of below described antenna element and dummy elements.

Figure 2:
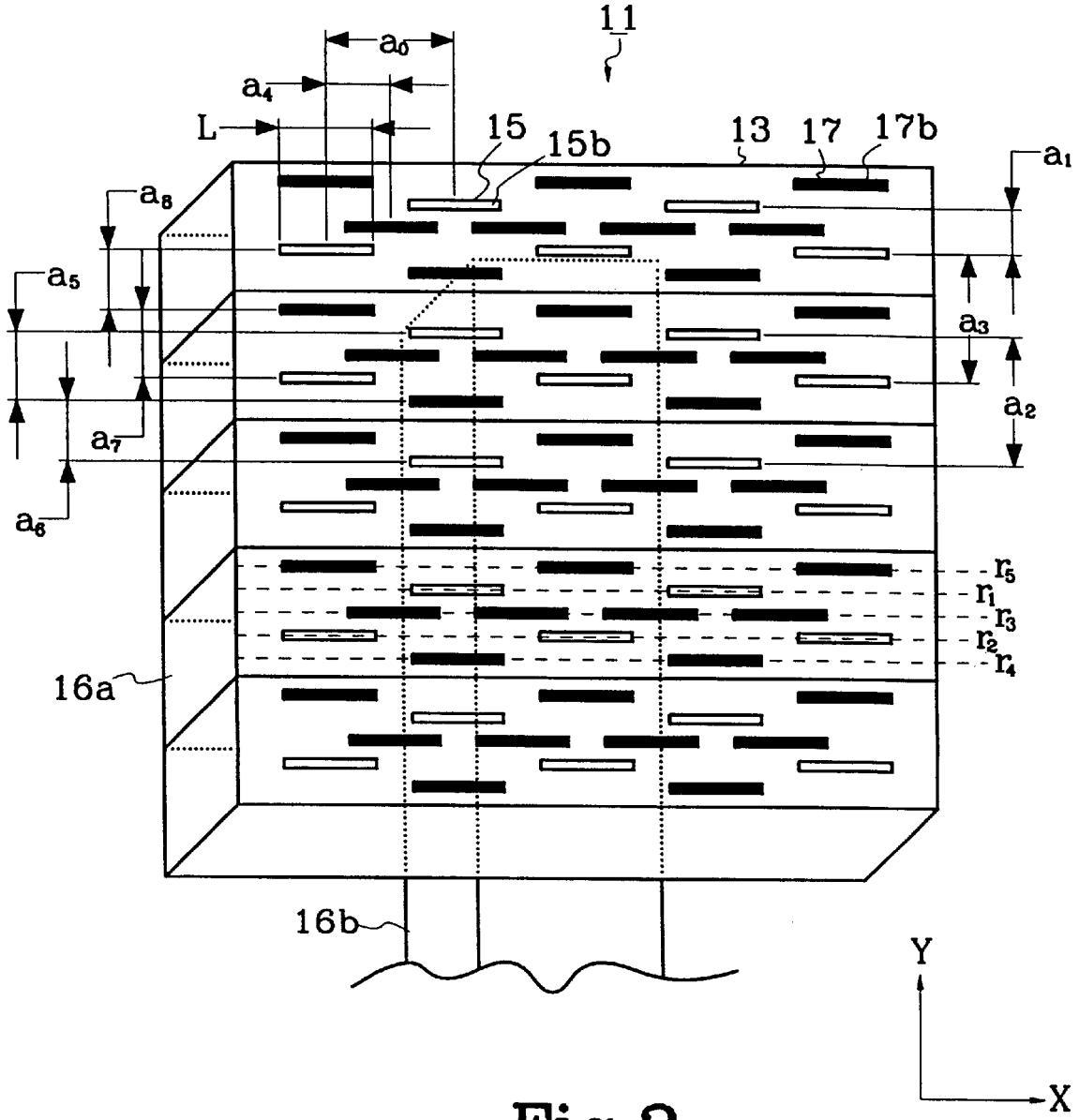
FIG. 2 shows a schematic perspective front view of an antenna device of the invention.

In the fixed co-ordinate system of the antenna device according to the present invention, the X-axis and Y-axis are in the plane of the paper, wherein the X-axis is parallel to the rows of each section, said rows being described in more detail below, and the Y-axis is perpendicular to the X-axis, as is illustrated in FIG. 2.

Since the distance in X-direction between the antenna elements and the distances in Y-direction between the antenna elements in the antenna device of the invention are less than half a wave length of the threat frequency of the antenna device, there will be no grid lobes in the radar cross section of the antenna device, because the grid lobes are displaced up in frequency to a frequency range outside the threat frequency of the antenna device, as disclosed above.

FIG. 2 illustrates a perspective front view of an antenna device 11 according to the invention comprising five sections stacked onto each other.

In the present examples, each section comprises a disc 13 with two rows of irradiating antenna elements 15.

In the example below, the disc 13 of the invention constitutes a flat two dimensional surface, but the invention can also be used by a surface having other shapes.

The irradiating antenna elements 15 consist of through openings 15*b* in the disc 13, wherein the openings 15*b* in each section of the antenna device 11 is fed with microwave signals from a wave guide 16*a*, see FIG. 2, which in turn is fed by a feeding wave guide 16*b* by a slot (not shown in FIG. 2).

A first row $r_1$ of each section comprises two pieces of irradiating antenna elements 15 and a second row $r_2$ of each section comprise three pieces of irradiating antenna elements 15.

The distance in X-direction between the mid-points of nearby irradiating antenna elements 15 in each section is designated $a_0$ in the figure. This distance $a_0$ is uniform between each nearby irradiating antenna element 15 in each section. The distance $a_0$ is, in this example, equal to 0,7 wave lengths of the working frequency of the antenna device.

All wave lengths disclosed in this text are free space wave lengths.

The distance in Y-direction between the mid-points of the irradiating antenna elements in the first row $r_1$ and the mid-points of the irradiating antenna elements in the second row $r_2$ of each section are designated $a_1$ in the figure and this distance $a_1$ is less than half a wave length of the working frequency of the antenna device, as described above.

The distance in Y-direction between the mid-points of the irradiating antenna elements in the firsts rows $r_1$ of nearby sections are designated $a_2$ in the figure and this distance $a_2$ is equal to 0,7 wave lengths of the working frequency of the antenna device.

Likewise, the distance in Y-direction between the mid-points of the irradiating antenna elements in the second rows $r_2$ of nearby sections, designated $a_3$ in the figure, equal 0,7 wave lengths of the working frequency of the antenna device.

The invention is not limited to the above disclosed number of irradiating antenna elements 15, but the number of irradiating antenna elements 15 can vary between different embodiments of antenna devices. Likewise, the number of rows $r_1$, $r_2$ and the number of sections of the antenna device can vary.

Furthermore, each section of the antenna device 11 comprises so-called dummy elements 17, which dummy elements 17 differ from the irradiating antenna elements 15 in such a way that the dummy elements 17 are not fed by a feeding net work, but are dummies. On the other hand, the dummy elements 17 behave in the same way as regards the rescattering of the irradiating antenna elements 15, when they are irradiated with signals from outside.

The dummy elements 17 in the antenna device 11 consist of recesses 17*b* in the disc 13, which are not through, and the dummy elements 17 are of the same magnitude as the irradiating antenna elements 15. Furthermore, the dummy elements 17 are of the same type of elements as the irradiating antenna elements 15.

A third row $r_3$ of dummy elements 17 is arranged between the first row $r_1$ and the second row $r_2$ of each section in the antenna device 11 according to the present invention.

The third row $r_3$ of the antenna device 11 comprises four pieces of dummy elements 17. These dummy elements 17 are arranged in the third row $r_3$ so the mid-points of the dummy elements 17 are arranged in X-direction between the mid-points of the nearest situated irradiating antenna elements 15 in the first row $r_1$ and in the second row $r_2$ of the section.

Furthermore, these dummy elements 17 are arranged in the third row $r_3$ so the distance in X-direction between the mid-points of nearby elements 15, 17 becomes less than half a wave length of the threat frequency of the antenna device. This distance is designated $a_4$ in the figure.

For instance, the dummy elements 17 are arranged in between the mid-points of the nearest situated irradiating antenna elements 15 in the first row $r_1$ and in the second row $r_2$ of the section.

A fourth row $r_4$ with dummy elements 17 is arranged below the second row $r_2$ of each section of the antenna device 11.

The fourth row $r_4$ comprises two pieces of dummy elements 17. These dummy elements 17 are arranged in the fourth row $r_4$ exactly straight under the two irradiating antenna elements 15 in the first row $r_1$.

Furthermore, these dummy elements 17 are arranged in the fourth row $r_4$ so the distance in Y-direction between the mid-points of the dummy elements and nearest above situated mid-point of the irradiating antenna element in the first row $r_1$ becomes less than half a wave length of the threat frequency of the antenna device. This distance is designated $a_5$ in the figure.

Likewise these dummy elements 17 are arranged in the fourth row $r_4$, so the distance in Y-direction between the mid-points of the dummy elements and the present below situated mid-point of the irradiating antenna element in the first row $r_1$ in the present below situated section of the antenna device 11 becomes less than half a wave length of the threat frequency of the antenna device. This distance is designated $a_6$ in the figure.

Furthermore, according to the invention, three dummy elements 17 are arranged in a fifth row $r_5$ above the first row $r_1$ of each section of the antenna device 11.

These dummy elements 17 are arranged in the fifth row right above three irradiating antenna elements 15 in the second row $r_2$.

Furthermore, these dummy elements 17 are arranged in the fifth row $r_5$, so the distance in Y-direction between the mid-points of the dummy elements and the mid-points of the nearest situated irradiating antenna elements in the second row $r_2$ becomes less than half a wave length of the threat frequency of the antenna device. This distance is designated $a_7$ in the figure.

Likewise, these dummy elements 17 are arranged in the fifth row $r_5$, so the distance in Y-direction between the mid-points of the dummy elements and the mid-point of the nearest, where appropriate above situated, irradiating antenna element in the second row $r_2$ in the, where appropriate above situated, section of the antenna device 11 becomes less than half a wave length of the threat frequency of the antenna device. This distance is designated $a_8$ in the figure.

The irradiating antenna elements 15 and the dummy elements 17 are arranged in a periodical pattern in the disc 13, as is illustrated in FIG. 2.

The number of elements 17 and their arrangement in each section of the antenna device 11 is not limited to what is disclosed above, but varies depending on the design of the antenna device and the arrangement of the irradiating elements 15 in the antenna device, and the relation between the working frequency and the threat frequency of the antenna device 11.

Above disclosed irradiating antenna elements 15 of the antenna device 11 are not limited to be openings but can consist of for instance dipoles, wave guide openings or micro strip elements, wherein the dummy elements 17 of the antenna device 11 are of the same type of elements as the irradiating antenna elements 15.

According to an alternative embodiment of the examples disclosed above, the distances $a_2$ and $a_3$ in Y-direction between the mid-points of the irradiating antenna elements are less than half a wave length of the threat frequency of the antenna device. In this case, the invention does not use the fourth row $r_4$ or the fifth row $r_5$ of dummy elements 17 according to the present example. However, the third row $r_3$ of the dummy elements 17 is used, as the distance $a_0$ in x-direction between the mid-points of the irradiating antenna elements are larger than half a wave length of the threat frequency of the antenna device elements.

According to an alternative embodiment of the invention, an additional ground plane can be used, comprising through original antenna elements, said original antenna elements conforming to the irradiating antenna elements 15 of the antenna device 11, as the ground plane approaches the antenna device 11.

Furthermore, the ground plane comprises the dummy elements 17 as disclosed above, wherein the ground plane is supplied to the antenna device afterwards. The dummy elements 17 are arranged in the ground plane in the same way as is disclosed above according to the examples with reference to accompanying FIG. 2.

According to the embodiments above, the device of the invention is arranged in the two dimensional X-Y -plane, but the invention can also be employed for surfaces in the three dimensional space.

We claim:

1. A device for eliminating grid lobes within a radar cross section of an antenna device (11), comprising an area (13) with rows of one or more ordinary elements ($r_1$, $r_2$), said ordinary elements (15) being arranged to be supplied with micro wave signals and are arranged in a periodical pattern in the antenna device (11) forming said rows in different directions, wherein incoming signals to the antenna device (11), which signals constitute a threat to the antenna device (11), comprise frequencies within a threat frequency of the antenna device (11), characterized in that one or more rows of one or more dummy elements ($r_3$, $r_4$, $r_5$), said dummy elements (17) being arranged not to be supplied by microwave signals, are arranged in the surface (13) between rows of ordinary elements so the distance ($a_4$, $a_5$, $a_6$, $a_7$, $a_8$) between nearby rows of ordinary elements (15) and dummy elements (17) is less than half a wave length of the threat frequency of the antenna device (11).

2. An antenna device according to claim 1, characterized in that the dummy elements (17) are of the same type as the ordinary elements (15) and that the dummy elements (17) are of the same magnitude as the ordinary elements (15).

3. An antenna device according to claim 2, characterised in that the ordinary elements (15) comprise through openings **(15*b*) in the surface (13)**.

4. An antenna device according to claim 3, characterized in that the dummy elements (17) do not constitute through recesses **(17*b*) in the surface (13)**.

5. An antenna device comprising a plane and an antenna device (11) comprising rows of one or more ordinary elements ($r_1$, $r_2$), which ordinary elements (15) are arranged to be fed with microwave signals and are arranged in a periodical pattern in the antenna device (11) forming said rows in different directions, wherein incoming signals to the antenna device (11), which signals constitute a threat to the antenna device (11), comprise frequencies within a threat frequency of the antenna device (11), characterized in that the plane comprises rows of one or more original antenna element, which are connecting to the ordinary antenna elements (15) of the antenna device (11) in a position when the plane is brought together with the antenna device (11), and that the plane furthermore comprises one or more rows of one or more dummy elements ($r_3$, $r_4$, $r_5$), said dummy elements (17) being arranged not to be fed with microwave signals when the plane is brought together with the antenna device (11), and the dummy elements (17) are arranged in the plane between rows of original elements, so the distance ($a_4$, $a_5$, $a_6$, $a_7$, $a_8$) between nearby rows of original elements and dummy elements (17) are less than half a wave length of the threat frequency to the antenna device (11).

6. An device according to claim 5, charaterized in that the dummy elements (17) of the plane are of the same type of elements as the ordinary elements (15) of the antenna device (11) and that the dummy elements (17) are of the same magnitude as the ordinary elements (15).

7. A device according to claim 6, characterized in that the original elements constitute through openings in the plane.

8. A device according to claim 7, characterized in that the dummy elements (17) constitute not through recesses **(17*b*)** in the plane.

* * * * *